United States Patent [19]

Iyengar

[11] Patent Number: 4,562,937

[45] Date of Patent: Jan. 7, 1986

[54] INTERNALLY-SEATING CONTAINER CLOSURE

[75] Inventor: Mike Iyengar, Chicago, Ill.

[73] Assignee: American Hospital Supply Corporation, Evanston, Ill.

[21] Appl. No.: 518,244

[22] Filed: Jul. 28, 1983

[51] Int. Cl.[4] ..... B65D 39/00

[52] U.S. Cl. ..... 220/307

[58] Field of Search ..... 220/307, 352, 367; 229/43, 1.5 B

[56] References Cited

U.S. PATENT DOCUMENTS

| | | | |
|---|---|---|---|
| 3,460,711 | 8/1969 | Al-Roy | 220/307 |
| 4,027,776 | 6/1977 | Douglas | 220/281 |
| 4,141,462 | 2/1979 | Rucci | 220/367 |
| 4,300,700 | 11/1981 | Chang | 220/307 |

*Primary Examiner*—George T. Hall

*Attorney, Agent, or Firm*—Patrick F. Bright; Donald L. Barbeau

[57] ABSTRACT

A container closure includes a cover portion and a rim portion at the edge of, and upstanding from the cover portion; the rim includes a flat, solid, annular ring member surrounding a raised, solid, round-shouldered, circular center area; the rim portion surrounds the cover portion and includes an upstanding, annular wall with an outwardly-projecting annular flange for engaging the inner surface of a container at its opening and, at the top edge of the annular wall, a planar flange parallel to the cover portion for seating on the rim of a container opening.

3 Claims, 4 Drawing Figures

INTERNALLY-SEATING CONTAINER CLOSURE

This invention relates to container closures and, in particular, to container closures having container-engaging surfaces that fit inside the openings in such containers.

Our new container closures comprise a cover portion and a rim portion at the edge of, and upstanding from the cover portion. This rim portion includes means for engaging the inner surfaces of containers at or near their openings. In a preferred embodiment, the cover portion includes a flat, solid, annular ring member surrounding a raised, solid, round-shouldered, circular center area. The raised, solid, round-shouldered, circular center area provides greater strength than a cover portion that lies substantially entirely within one plane. The center area also includes a small opening, centrally located, for pressure release of gas or liquid. The rim portion surmounts, and surrounds the cover portion, and includes an upstanding, annular wall having, at its top edge, an annular, planar flange parallel to the cover portion. This annular planar flange projects outwardly from the upstanding annular wall, and its bottom surface serves to engage the lip of a container opening when our new container closure is inserted into such an opening. The upstanding, annular wall in the rim portion of our new container closure also includes an outwardly-projecting, annular flange that includes means for engaging the inner surface of a container along a substantially unbroken line.

In preferred embodiments, our new container closure is made of a thermoplastic such as high impact polystyrene, is integrally formed by a vacuum, and is of one-piece construction. Preferably, too, the outwardly-projecting, annular planar flange that forms part of the rim portion of our new container closure includes a tab or other means for grasping the closure and for removing it from a container or from a stack of other such closures.

Our new container closure can better be understood by reference to the drawings accompanying this specification, in which.

Figure 1:
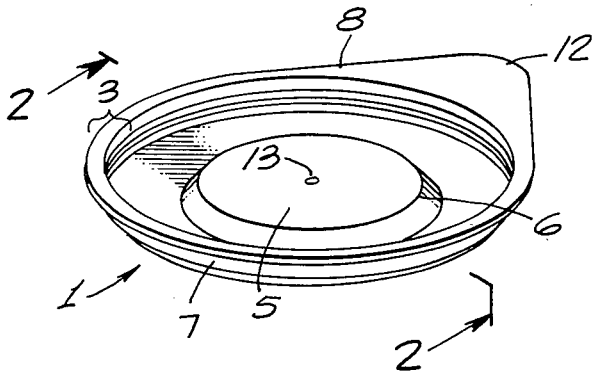
FIG. 1 is a perspective view of a preferred embodiment of our new container closure.
Figure 2:
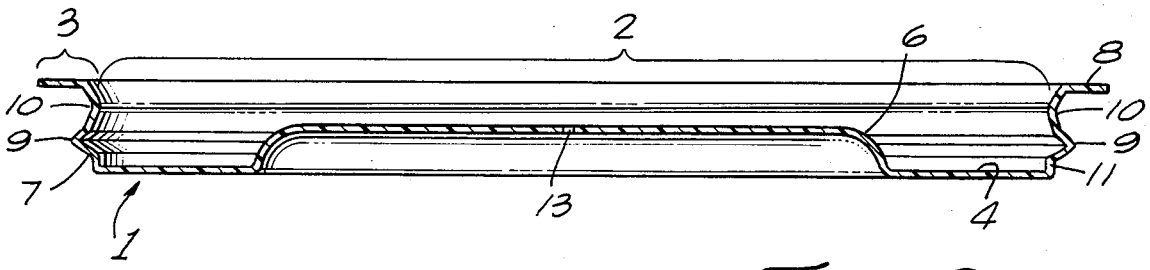
FIG. 2 is a cross-sectional elevation view of the closure shown in FIG. 1, taken on line 2—2 of FIG. 1.
Figure 3:
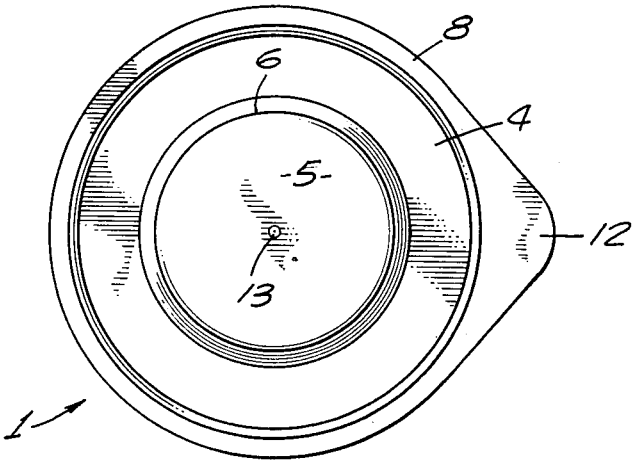
FIG. 3 is a top plan view of the container closure shown in FIGS. 1 and 2.
Figure 4:
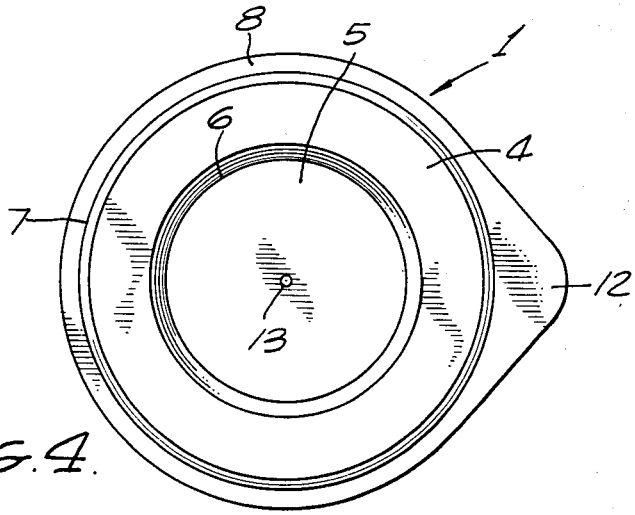
FIG. 4 is a bottom plan view of the new closure illustrated in FIGS. 1–3.

Referring now to the drawings, our new closure, generally designated 1, includes a cover portion, generally designated 2, and a rim portion, generally designated 3. Cover portion 2 includes a flat, solid, annular ring member 4 surrounding a raised, solid, circular center area 5 having rounded shoulders 6. Center area 5 strengthens the cover portion, making it stronger and more resilient than a cover portion that lies within a single plane. Center area 5 includes small, pressure relief opening 13.

Rim portion 3 surrounds cover portion 2, and includes upstanding, annular wall 7. At the top edge of, and projecting outwardly from annular wall 7, is annular, planar flange 8. Flange 8 is parallel to cover portion 2. The bottom surface of annular, planar flange 8 provides a sealing surface for engagement with the upper edge or lip of a container opening. Upstanding, annular wall 7 includes outwardly-projecting annular flange 9. Flange 9 lies between, and is formed in part by inwardly-projecting, annular wall portions 10 and 11. Flange 9 includes means for engaging the inner surface of a container along a substantially unbroken line; here, this means is the outwardly-projecting, annular line at the outermost edge of flange 9.

Tab 12, integrally formed with planar, annular flange 8, provides means for grasping the new container closure, and for pulling our new closure from the inside of a container opening.

Our new container closure engages the inner surface of a container, near its opening, along a line surface formed by the outermost edge of the outwardly-projecting, annular flange such as flange 9. Complementing this positive seal between the inner surface of the container at its opening and our new closure is the bottom surface of the outwardly-projecting, planar flange 8. This bottom surface engages the lip of a container at its opening, providing a second seal and preventing undesirable travel of the closure into a container a distance greater than necessary to close and seal the container at its opening.

What is claimed is:

1. A circular, one-piece closure of thermoplastic material for fitting inside and sealing the opening of a cylindrical container comprising:

a circular, resilient cover portion having a substantially flat, annular ring surrounding a raised, circular center area; said circular center area having a shoulder projecting downwardly and outwardly from the outer edge of the center area to the inner edge of said annular ring portion;

a circular rim portion surrounding the outer edge of said cover portion and having an upstanding, annular wall;

said upstanding wall having a substantially planar annular flange disposed at the top edge of said wall and projecting outwardly therefrom; said planar annular flange being disposed substantially parallel to said cover portion, and having a sealing means disposed adjacent its bottom surface for engaging the inner surface of the lip of the container at its opening and providing a sealing surface for engagement with the upper edge of the container opening; said sealing means comprising a rim projecting outwardly from the upstanding wall; and an outwardly-projecting annular flange for engaging the container along a substantially unbroken line at the outermost edge of said flange; said flange projecting outwardly from the upstanding wall and being disposed between the sealing means and the lower portion of said annular wall.

2. The container closure of claim 1 further including a tab for grasping the closure, said tab extending outwardly from said planar annular flange.

3. The container closure of claim 2 further including an opening in the circular center area.

* * * * *